United States Patent [19]

Berger

[11] 4,100,684

[45] Jul. 18, 1978

[54] HOLDER DEVICE FOR PAPER ARTICLES AND WRITING INSTRUMENTS

[76] Inventor: Stuart Berger, 12 Overton Rd., East Windsor, N.J. 08520

[21] Appl. No.: 698,073

[22] Filed: Jun. 21, 1976

[51] Int. Cl.[2] ..... A47F 7/00; A47B 96/06; B43L 5/02

[52] U.S. Cl. ..... 35/62; 211/50; 211/88; 248/206 A; 35/63

[58] Field of Search ..... 211/88, 42, 69, 69.1, 211/50, 51; 248/205 R, 205 A, 206 R, 206 A; 312/45, 72, 73, 50; 35/61–63

[56] References Cited

U.S. PATENT DOCUMENTS

| | | | |
|---|---|---|---|
| 1,455,219 | 5/1923 | Morina | 312/50 |
| 1,713,275 | 5/1929 | Gibson | 211/88 |
| 2,667,394 | 1/1954 | Goetz et al. | 312/73 |
| 2,862,626 | 12/1958 | Clare | 211/88 |
| 3,207,566 | 9/1965 | Grieco et al. | 248/205 R X |
| 3,261,126 | 7/1966 | Marks | 248/205 A X |
| 3,314,634 | 4/1967 | Carter | 248/206 A |
| 3,350,045 | 10/1967 | Mayers | 248/205 X |
| 3,365,684 | 1/1968 | Stemke et al. | 248/206 A X |
| 3,570,677 | 3/1971 | George | 211/42 |

*Primary Examiner*—Roy D. Frazier
*Assistant Examiner*—Terrell P. Lewis

[57] ABSTRACT

A holder device for holding paper articles and writing instruments includes a housing having a pair of compartments therein. A permanent magnet is mounted on the housing and is removably received on a ferrous metallic bar which is mounted on a stationary object. An ejector assembly is contained in one of the compartments for ejecting the writing instruments from the compartment.

7 Claims, 6 Drawing Figures

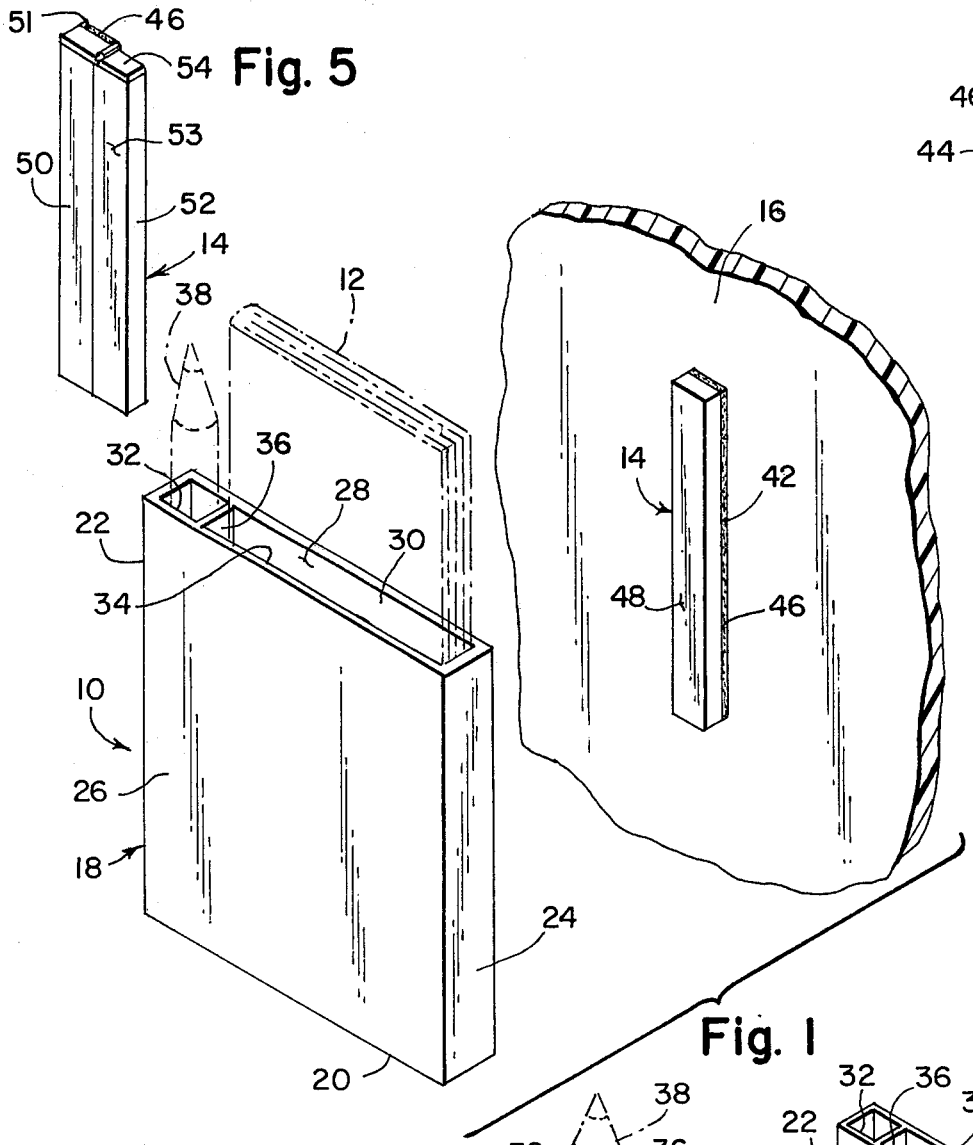
Fig. 5
Fig. 1
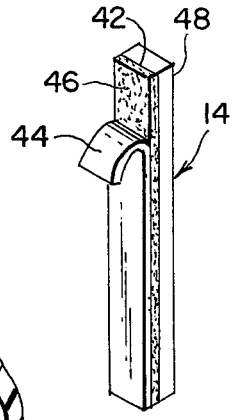
Fig. 4
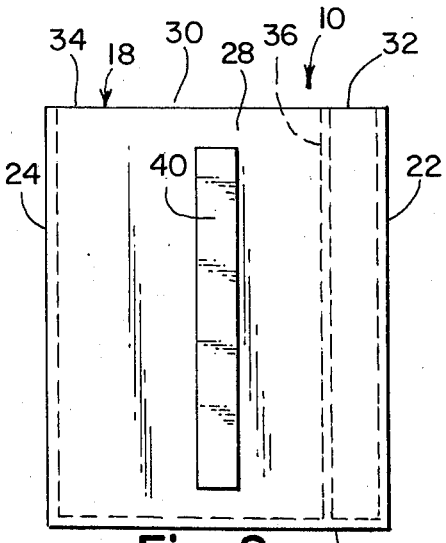
Fig. 2
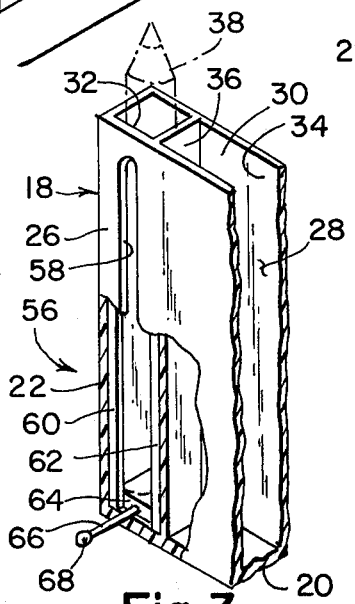
Fig. 3
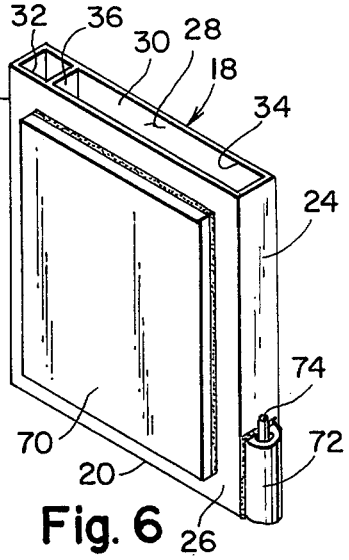
Fig. 6

HOLDER DEVICE FOR PAPER ARTICLES AND WRITING INSTRUMENTS

BACKGROUND OF THE INVENTION

A number of U.S. patents relate to devices for holding and support books and various other articles. These U.S. Patents are: 1,562,275 to Armstrong; 1,815,304 to Krag; 1,910,773 to Richter; 2,019,826 to McKee; 2,603,357 to Zakos; 2,979,120 to Amburn; and 3,570,677 to George. These aforementioned patents are non-applicable to my present instant invention which provides a device for holding paper articles as well as writing instruments and provides a means for removably securing the device to a stationary object.

SUMMARY OF THE INVENTION

My present invention relates to a unique and novel holder device for paper articles and writing instruments.

An object of my present invention is to provide a holder device for paper articles and writing instruments which is removably mounted to a stationary object.

A further object is to provide a means for rotating the device 90° outwardly from the stationary object.

A still further object of my present invention is to provide a blackboard means for writing temporary messages, wherein the blackboard means is integrally joined to the housing of the device.

A still further object of my present invention is to provide an ejector assembly for easy removal of the writing instruments from the device.

Briefly, my present invention, a holder device for paper articles and writing instruments, comprises an elongated metallic mounting bar member adhesively secured to a stationary object. A housing has at least two compartments therein for holding the paper articles and writing instruments. A permanent magnet is mounted on the housing and is removably received onto the mounting bar. An ejector assembly is provided for removal of the writing instruments from the housing.

BRIEF DESCRIPTION OF THE DRAWINGS

The objects and features of the invention may be understood with reference to the following detailed description of an illustrative embodiment of the invention, taken together with the accompanying drawings, in which:

FIG. 1 illustrates a front exploded perspective view of a holder device for paper articles and writing instruments;

FIG. 2 illustrates a rear view of the device;

FIG. 3 illustrates a front cross-sectional perspective view of a portion of the device;

FIG. 4 illustrates a rear perspective view of a mounting bar of the device;

FIG. 5 illustrates a front perspective view of a second embodiment of the mounting bar of the device; and FIG. 6 illustrates a front perspective view of the device having a blackboard element.

DESCRIPTION OF THE PREFERRED EMBODIMENT

Turning now descriptively to the drawings, in which similar reference characters denote similar elements throughout the several views, FIGS. 1-2 show a holder device 10 adapted to receive paper articles 12 such as newspaper, paper, magazines like a T.V. guide or food coupons therein and adapted to be removably secured to a metallic bar 14 affixed onto a stationary object 16 like a television, a refrigerator, or even a wall.

The device 10 generally comprises a housing 18 having a base 20, a pair of upwardly extending end walls 22, 24, an upwardly extending forward wall 26, an upwardly extending rear wall 28, and an open top 30, wherein the housing 18 defines a relatively deep elongated chamber therein. The chamber is divided into a left 32 and a right 34 compartment by an intermediate vertical wall 36 disposed parallel to the end walls 22, 24. The right compartment 34 is adapted to receive the paper articles 12 therein and the left smaller compartment 32 is adapted to receive a writing means 38 such as a pencil or pen therein. A large permanent elongated magnet 40 is mounted centrally on the rear wall 28 of housing 18. An elongated metallic bar member 14, as depicted in FIGS. 1, 4, is adhesively secured to object 16. An adhesive layer 46 is deposited on the rear surface 42 of member 14, wherein the adhesive layer 46 is covered by a peel-off layer 44. In use, layer 44 is peeled off. The bar member 14 is secured to the object 16 by means of the pressure sensitive adhesive layer 46. The permanent magnet 40 is removably received onto the front surface 48 of the bar member 14.

A further embodiment of the mounting bar 14 is depicted in FIG. 5, wherein the bar 14 comprises two elongated metallic sections 50, 52 joined together at first ends of each section 50, 52 by a hinge means 54. The back surface 51 of the first section 50 has the adhesive layer 46 deposited thereon for securing means to the stationary object 16. The permanent magnet 40 is removably received onto the front face 13 of the second section 52. When section 52 is disposed at a 90° angle to section 50, the housing 18 is aligned at a 90° angle to the object 16 thereby allowing the user easier access in certain confined areas.

FIG. 3 shows an ejector assembly 56 for easy removal of the writing means 38 from the left compartment 32 of housing 18. The forward wall 26 has a vertically disposed elongated slotted opening 58 therethrough. A pair of vertically aligned guide tracks 60, 62 are disposed within compartment 32, wherein one track 60 is affixed to end wall 22 and the other track 62 is mounted on intermediate wall 36. A horizontally aligned plate member 64 is disposed within compartment 32 and slideably mounted within the tracks 60, 62. The lower ends of the writing means 38 are adapted to rest on top of plate member 64. A rod element 66 is affixed to one end of plate member 64 and extends outwardly through opening 58. A handle member 68 is affixed to the outer end of rod element 66 and is disposed externally to housing 18. In use, handle member 68 is pushed upwardly causing plate member 64 to move upwardly thereby ejecting the writing means 38 upwardly through the open top 30.

FIG. 6 depicts a means for writing a message on the housing 18 for such purposes as composing a telephone list, a grocery list or a television viewing list. The writing means comprises a blackboard member 70 adhesively secured to the forward wall 26 of the housing 18. A cup like receptacle 72 is adhesively secured to end wall 24 of the housing 18, wherein receptacle 72 is adapted to receive chalk 74 thereon for writing messages on blackboard 70.

I claim:

1. A holder device adapted for receiving paper articles and writing means therein and for being removably secured to a stationary object, which comprises:

(a) an elongated bar member, said bar member including a ferrous metallic element having an adhesive layer deposited thereon, said adhesive layer adhesively adhering said metallic element to said stationary object, said bar member further including two elongated sections, and a hinge means joining said sections;

(b) a housing having at least two vertical compartments therein with an open top, one said compartment for receiving said paper articles, and other of said compartments for receiving said writing means; and (c) means for removably securing said housing to said bar member, said removable securing means including a permanent magnet mounted on said housing, said permanent magnet removably receivable onto said metallic bar member.

2. A device according to claim 1, wherein said housing comprises a base, a pair of end walls, a forward wall, a rear wall, an intermediate vertical wall, and said open top.

3. A device according to claim 1, wherein a blackboard element is affixed onto said housing.

4. A device according to claim 3, wherein a cup like receptacle is affixed onto said housing, said receptacle adapted for receiving chalk thereon for writing messages on said blackboard.

5. A device according to claim 1, further comprising an ejector assembly for removing said writing means from said other compartment.

6. A device according to claim 5, wherein said ejector assembly further comprises:

(a) a plurality of vertical guide tracks disposed within said other compartment;

(b) a plate member disposed within said other compartment, said plate member slideably communicating with said guide tracks, said plate member adapted for receiving said writing means thereon; and (c) means for moving said plate member.

7. A device according to claim 6, wherein said moving means further comprises:

(a) a rod element affixed linearly to said plate member, said rod member extending outwardly through said housing; and (b) a handle member affixed to an outer end of said rod element, said handle member disposed externally to said housing.

* * * * *